US006210794B1

(12) United States Patent
Nakamura

(10) Patent No.: US 6,210,794 B1
(45) **Date of Patent: *Apr. 3, 2001**

(54) THERMAL TRANSFER SHEET

(75) Inventor: Koichi Nakamura, Tokyo-to (JP)

(73) Assignee: Dai Nippon Printing Co., Ltd., Tokyo-to (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/829,986

(22) Filed: Apr. 1, 1997

(30) Foreign Application Priority Data

Apr. 3, 1996 (JP) ..... 8-104780
Apr. 3, 1996 (JP) ..... 8-104781

(51) Int. Cl.[7] ..... B41M 5/26

(52) U.S. Cl. ..... 428/346; 428/195; 428/352; 428/354; 428/480; 428/484; 428/913; 428/914

(58) Field of Search ..... 428/195, 212, 428/484, 488.1, 488.4, 913, 914

(56) References Cited

FOREIGN PATENT DOCUMENTS

| | | | |
|---|---|---|---|
| 0279467 | 8/1988 | (EP) | 428/195 |
| 0510661 | 10/1992 | (EP) | 428/195 |
| 0673789 | 9/1995 | (EP) | 428/195 |
| 0698504 | 2/1996 | (EP) | 428/195 |

*Primary Examiner*—Bruce H. Hess
(74) *Attorney, Agent, or Firm*—Ladas & Parry

(57) ABSTRACT

A thermal transfer sheet comprises a substrate sheet, a release layer formed on one surface of the substrate sheet, a coloring layer formed on the release layer and an adhesive layer formed on the coloring layer. The release layer and the adhesive layer are formed from the same kind of material.

Another thermal transfer sheet comprises a substrate sheet and a heat fusible coloring ink layer formed on one surface of the substrate sheet. An organic pigment of benzimidazolone-mono-azo is used as a coloring agent of yellow, a mixture of organic pigments of quinacridone-mono-azo and benzimidazolone-mono-azo is used as a coloring agent of magenta, and an organic pigment of phthalocyanine is used as a coloring agent of cyan, in the heat fusible coloring ink layer.

5 Claims, 1 Drawing Sheet

A1

THERMAL TRANSFER SHEET

BACKGROUND OF THE INVENTION

1. Field of the Invention

The present invention relates to a thermal transfer sheet to be used for a thermal transfer printer utilizing a heating means such as a thermal head and a laser, and more specifically to a thermal transfer sheet which provides good printing quality in thermal printing in full color and has an excellent color reproduction property, and is therefore adapted to be used for a poster, an information board, and to a thermal transfer sheet having improved weatherproofing property, wear resistance and chemical resistance property, in which a plastic substrate as an image receiving sheet to which an image has thermally been transferred with the use of the thermal transfer sheet is adapted to be used for an open-air article such as a license plate for a vehicle such as a car, a road sign, or the like.

2. Description of the Related Art

There has conventionally been known a fusion transfer method in which a coloring agent is transferred to a image receiving sheet such as paper and a plastic sheet by impressing energy corresponding to image information by means of a heating device such as a thermal head with the use of a thermal transfer sheet obtained by carrying a coloring layer or a heat fusible coloring ink layer in which coloring agents such as pigment and dye are dispersed in a binder such as heat fusible wax or resin, on a substrate sheet such as a plastic film.

The transferred image formed by this fusion transfer method has high density and is excellent in clarity, and is therefore adapted to record a binary image such as a character or a line drawing. It is also possible to form a polychrome or color image with the use of decreased kinds of color by making a multiple printing record of coloring layers or heat fusible coloring ink layers on an image receiving sheet by using a thermal transfer sheet having the heat fusible coloring ink layers of yellow, magenta, cyan and the like.

However, there have been many conventional thermal transfer sheets having the coloring layer, in which a wax was used as a binder of the coloring layer, and such conventional thermal transfer sheets had a remarkable problem that image-printed material obtained thereby was poor in wear resistance.

In view of this problem, another thermal transfer sheet has been prepared using a resin as the binder of the coloring layer. When a multiple printing of the coloring layer was conducted with the use of such a kind of the thermal transfer sheet, there was however caused a problem of incomplete printing, i.e., a void or a printing defect on an overlapped portion of the coloring layers.

In the conventional thermal transfer sheet having the heat fusible coloring ink layer, the coloring agents used therein, especially pigments of yellow and magenta do not have a high weatherproofing property. As a result, the indoor normal use of the thermal transfer sheet for materials such as a leaflet or a brochure causes no problem, whereas the outdoor use thereof with its exposure to direct sunlight cause a problem of fading.

SUMMARY OF THE INVENTION

The first object of the present invention is therefore to provide a thermal transfer sheet which permits to solve the above-mentioned problems with the result that a printed material obtained by the thermal printing with the use of the thermal transfer sheet can have a good printing quality without the occurrence of the void and the printing defect on an overlapped portion of the coloring layers, and has an excellent color reproduction property in full color.

The second object of the present invention is to provide a thermal transfer sheet in which a printed material obtained by the thermal printing with the use of the thermal transfer sheet has an excellent weatherproofing property, thus permitting the production of a color image without the occurrence of change such as fading even when the printed material is applied to the outdoor use.

The thermal transfer sheet of present invention for attainment of the aforementioned first object which comprises a substrate sheet, a release layer formed on one surface of said substrate sheet, a coloring layer formed on said release layer and an adhesive layer formed on said coloring layer, is characterized in that said release layer and said adhesive layer are formed from a same kind of material.

According to the above-mentioned thermal transfer sheet of the present invention, by forming the release layer, the coloring layer and the adhesive layer in this order on the one surface of the substrate sheet, it is possible to impart the releasability, coloring property and adhesivity provided by these layer to the thermal transfer sheet so as to carry out effectively these functions. A multiple printing is often conducted with the use of the thermal transfer sheet by carrying out the first thermal transfer step to transfer the first set of the adhesive layer, the coloring layer and the release layer in this order onto the surface of an image receiving sheet and then carrying out the second thermal transfer step to transfer the second set of the adhesive layer, the coloring layer and the release layer in this order onto the release layer of the first set so as to bring the release layer of the first set into contact with the adhesive layer of the second set. When such a multiple printing is conducted, the release layer of the first set and the adhesive layer of the second set which are brought into contact with each other, are fused to form the mixture thereof by heat for the thermal transfer printing, thus improving the adhesivity of the release layer and the adhesive layer and the reproducibility of printed characters in the form of dots, since the release layer and the adhesive layer are formed the same kind of material.

The aforementioned same kind of material may be carnauba wax, polyethylen wax or polyester resin.

The above-mentioned coloring layer may comprise a heat fusible coloring ink layer; and an organic pigment of benzimidazolone-mono-azo may be used as a coloring agent of yellow in said heat fusible coloring ink layer, a mixture of organic pigments of quinacridone-mono-azo and benzimidazolone-mono-azo may be used as a coloring agent of magenta in said heat fusible coloring ink layer, and an organic pigment of phthalocyanine may be used as a coloring agent of cyan in said heat fusible coloring ink layer.

Material mainly comprising resin may be used as a binder in said heat fusible coloring ink layer.

The thermal transfer sheet of present invention for attainment of the aforementioned second object which comprises a substrate sheet and a heat fusible coloring ink layer formed on one surface of said substrate sheet, is characterized in that an organic pigment of benzimidazolone-mono-azo is used as a coloring agent of yellow in said heat fusible coloring ink layer, a mixture of organic pigments of quinacridone-mono-azo and benzimidazolone-mono-azo is used as a coloring agent of magenta in said heat fusible coloring ink layer, and an organic pigment of phthalocyanine is used as a coloring agent of cyan in said heat fusible coloring ink layer.

According to the above-mentioned thermal transfer sheet of the present invention, by using in said heat fusible coloring ink layer the organic pigment of benzimidazolone-mono-azo as a coloring agent of yellow, the mixture of organic pigments of quinacridone-mono-azo and benzimidazolone-mono-azo a coloring agent of magenta and the organic pigment of phthalocyanine as a coloring agent of cyan, it is possible to impart an excellent weatherproofing property to a printed material obtained by the thermal printing with the use of the thermal transfer sheet, thus permitting the outdoor use of the printed material, unlike a printed material obtained by the thermal printing with the use of the conventional thermal transfer sheet, which cannot be applied to such an outdoor use.

Material mainly comprising resin may be used as a binder in said heat fusible coloring ink layer.

A release layer may be formed between said substrate sheet and said heat fusible coloring ink layer and an adhesive layer may be formed on said heat fusible coloring ink layer; and said release layer and said adhesive layer are formed from a same kind of material.

The above-mentioned same kind of material may be carnauba wax, polyethylene wax or polyester resin.

DETAILED DESCRIPTION OF THE PREFERRED EMBODIMENTS

Figure 1:
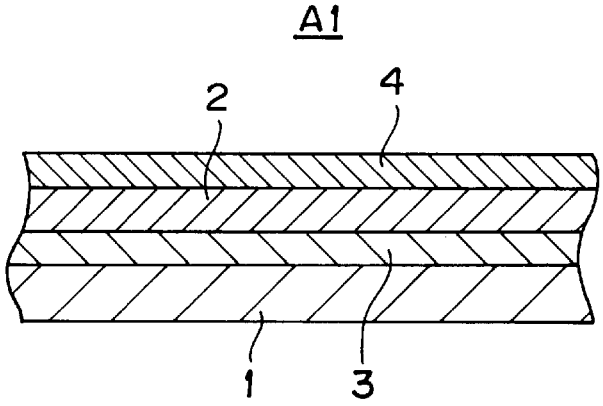
FIG. 1 is a schematic partial cross sectional view illustrating the thermal transfer sheet of the first embodiment of the present invention for attaining the first object.

Now, the thermal transfer sheet of the first embodiment of the present invention for attaining the first object will be described in detail with reference to FIG. 1. FIG. 1 is a schematic partial cross sectional view illustrating the thermal transfer sheet of the aforementioned first embodiment of the present invention.

As shown in FIG. 1, the thermal transfer sheet A1 of the first embodiment of the present invention comprises a substrate sheet 1, a release layer 3 formed on one surface of the substrate sheet 1, a coloring layer 2 formed on the release layer 3 and an adhesive layer 4 formed on the coloring layer 2.

Description will be given below of the substrate sheet 1, the coloring layer 2, the release layer 3 and the adhesive layer 4.

[Substrate sheet 1]

As the substrate sheet 1 used in the thermal transfer sheet A1, the same substrate sheet as that used in the conventional thermal transfer sheet may per se be used. There is however no specific restriction thereto.

The preferable example of the substrate sheet 1 may include polyester, polypropylene, cellophane, polycarbonate, cellulose acetate, polyethylene, polyvinyl chloride, polystyrene, nylon, polyimide, polyvinylidene chloride, polyvinyl alcohol, fluorine resin, chlorinated rubber, plastic such as ionomer, paper such as condenser paper or paraffin paper, or nonwoven fabric. The substrate sheet 1 may be formed in composite form of these materials. Although the thickness of the substrate sheet 1 may be optionally changed in accordance with a material to be used so as to provide suitable density and heat conductivity, it is preferably 2 to 25 $\mu$m, for example.

[Coloring layer 2]

In the coloring layer 2 of the thermal transfer sheet A1 of the present invention, there is applicable either an ink layer of any one color of yellow, magenta, cyan and black or an ink layer having a plurality of colors in which at least two kinds of ink of yellow, magenta, cyan and black are applied onto the substrate sheet 1 in the width direction or the longitudinal direction thereof. In either case, the respective ink layer comprises a coloring agent and a binder. Various kind of additives, for example a dispersion agent and an anti-static agent may be added as an occasion demands. A multiple printing can be conducted with the use of the thermal transfer sheet A1 of the present invention, in either case of the coloring layer 2 having the single color or the plurality of colors.

The coloring agents of yellow, magenta, cyan, black, etc. used in the present invention can properly be selected from the conventional dyes and pigments. The preferable coloring agents may include organic pigments of benzimidazolone-mono-azo, quinacridone, phthalocyanine, threne, dioxazine, isoindolinone, perylene, thioindigo, pyrrocoline, fulorpine and quinophthalone. These organic pigments have an excellent weatherproofing property, thus causing no occurrence of fading even when a printed material with the use of them is applied to an outdoor use such as a poster or an information board.

The binder used in the coloring agent 2 preferably mainly comprises a resin. The representative examples of the resin may include thermoplastic elastomer such as cellulose resin, melamine resin, polyester resin, polyamide resin, polyolefin resin, acrylic resin, styrene resin, ethylene-vinyl acetate copolymer, styrene-butadiene rubber and the like. It is preferable to use the resin having a relatively low softening point of 50 to 80° C. which has conventionally been used as a thermo-sensitive adhesive agent Of the resins used as the binder, the cellulose resin, melamine resin and acrylic resin are preferably used in view of the transferring property, the wear resistance, the heat resistance and the like.

A wax may be added to the resin to an extent that the heat resistance is not degraded, as an occasion demands. As a typical example of the wax, there will be listed up microcrystalline wax, carnauba wax or paraffin wax. Furthermore, the following waxes may be used: Fischer-Tropsch wax, various kinds of low molecular weight polyethylenes, Japan wax, bees wax, whale wax, insect wax, wool wax, shellac wax, candelilla wax, petrolatum, polyester wax, partially modified wax, fatty acid ester, fatty acid amide, and so on. Of these wax, it is preferable to use the wax having a melting point of 50 to 85° C. With a melting point of up to 50° C., there may be a problem of a storing property. With a melting point of at least 85° C., on the other hand, printing sensitivity may tend to be insufficient.

It is preferable to use an ink composition comprising the coloring agent of 90 to 20 wt. % and the resin of 80 to 10 wt. % in order to form the above-mentioned coloring layer 2. When the coloring agent content is smaller than 20 wt. %, an amount of the applied composition must be increased, thus leading to insufficient printing sensitivity. When the coloring agent content is larger than 90 wt. %, on the other hand, a sufficient film forming property may not be obtained, thus causing the deterioration of the wear resistance of a printed material.

The coloring layer 2 can be formed with the use of the coloring layer forming composition prepared by blending the aforementioned coloring agent and the binder, and in addition, a solvent such as water and organic solvent, if necessary, by means of the conventional known method such as a hot melt coating, a hot lacquer coating, a gravure direct coating, a gravure reverse coating, a knife coating, an air coating and a roll coating, so that the coloring layer 2 has a thickness of from 0.05 to 5 μm, preferably of from 0.3 to 1.5 μm in a dry condition.

When the thickness of the dried coating film is under 0.05 μm, there may occur a problem of the film forming property, making it impossible to form a uniform ink layer, thus leading to deterioration of the wear resistance of the printed material. When the thickness thereof is over 5 μm, on the other hand, high energy is required for the thermal transfer printing, with the result that the printing may be conducted only by the specific thermal transfer printer, and the printing sensitivity may tend to be insufficient.

[Release layer 3]

In the present invention, the release layer 3 is formed between the substrate 1 and the coloring layer 2. The release layer 3 mainly comprises a wax, and there may be added thereto the thermoplastic elastomer, for example, polyolefin resin, polyester resin or the like, as set forth in the description of the coloring layer 2.

As a typical example of the wax used for the release layer 3, there will be listed up micro-crystalline wax, carnauba wax or paraffin wax. Furthermore, the following waxes may be used: Fischer-Tropsch wax, various kinds of low molecular weight polyethylenes, Japan wax, bees wax, whale wax, insect wax, wool wax, shellac wax, candelilla wax, petrolatum, polyester wax, partially modified wax, fatty acid ester, fatty acid amide, and so on. Of these wax, it is preferable to use the wax having a melting point of 50 to 85° C. With a melting point of up to 50° C., there may be a problem of a storing property. With a melting point of at least 85° C., on the other hand, printing sensitivity may tend to be insufficient.

The thermal transfer sheet A1 of the present invention is characterized in that the release layer 3 and an adhesive layer 4 described later are formed from the same kind of material. The "same kind of material" means material having an excellent adhesivity to plastic material such as polyethylene terephthalate and vinyl chloride. As the above-mentioned same kind of material, there may be listed up the thermoplastic elastomer and the wax which are described above. Of these materials, it is preferably use carnauba wax, polyethylene wax or polyester resin. These materials may be used alone or in combination with each other.

The release layer 3 can be formed with the use of a release layer forming composition, by means of the conventional known method such as a hot melt coating, a hot lacquer coating, a gravure direct coating, a gravure reverse coating, a knife coating, an air coating and a roll coating, so that the coloring layer 2 has a thickness of from 0.05 to 5 μm in a dry condition. When the thickness of the dried film is under 0.05 μm, it is impossible to inhibit the adhesive property of the coloring layer 2 to the substrate sheet 1

[Adhesive layer 4]

According to the thermal transfer sheet A1 of the present invention, it is possible to improve the adhesivity between an image receiving sheet and the coloring layer 2 by forming the adhesive layer 4 on the coloring layer 2. The adhesive layer 4 mainly comprises thermoplastic elastomer which is soften to provide adhesivity by heat of a thermal head, a laser or the like. A blocking preventing agent such as of wax; amide, ester and salt of higher fatty acid; powder of fluoroplastics or inorganic material or the like may be added to the aforementioned elastomer in order to prevent a blocking phenomenon when winding the obtained thermal transfer sheet into a roll. As a typical example of the wax to be added to the elastomer, there will be listed up micro-crystalline wax, carnauba wax or paraffin wax. Furthermore, the following waxes may be used: Fischer-Tropsch wax, various kinds of low molecular weight polyethylenes, Japan wax, bees wax, whale wax, insect wax, wool wax, shellac wax, candelilla wax, petrolatum, polyester wax, partially modified wax, fatty acid ester, fatty acid amide, and so on.

As a typical example of the thermoplastic elastomer, there will be listed up ethylene-vinyl acetate copolymer (EVA), ethylene-acrylic acid ester copolymer (EEA), polyester resin, polyethylene, polystyrene, polypropylene, polybutene, petroleum resin, vinyl chloride resin, vinyl chloride-vinyl acetate copolymer, polyvinil alcohol, vinylidene chloride resin, methacrylate resin, polyamide, polycarbonate, polyvinylformal, polyvinyl butyral, acetylcellulose, nitrocellulose, polyvinyl acetate, polyisobutylene, ethylcellolose, polyacetal and the like. It is preferable to use the elastomer having a relatively low softening point, for example, of 50 to 150° C., which is conventionally used as the thermo-sensitive adhesive agent.

The thermal transfer sheet A1 of the present invention is characterized in that the adhesive layer 4 and the release layer 3 are formed from the same kind of material. The aforementioned same kind of material comprises the thermoplastic elastomer described above and wax. Of these materials, polyester resin, carnauba wax or polyethylene wax may preferably be used.

The adhesive layer 4 can be formed with the use of an adhesive layer forming composition which is obtained by dissolving or dispersing the above-mentioned thermoplastic elastomer and additive into a hot-melt coating composition or a proper organic solvent or water, by means of the conventional known method such as a hot melt coating, a hot lacquer coating, a gravure direct coating, a gravure reverse coating, a knife coating, an air coating and a roll coating, so that the adhesive layer 4 has a thickness of from 0.05 to 5 μm in a dry condition. With a thickness of the dried film of under 0.05 μm, there may be caused an inferior adhesivity between the image receiving sheet and the coloring layer 2, thus leading to occurrence of printing defect when conducting the thermal transfer printing. With a thickness thereof of over 5 μm, the printing sensitivity may be decreased when conducting the thermal transfer printing, thus making it impossible to obtain satisfactory printing quality.

Figure 2:
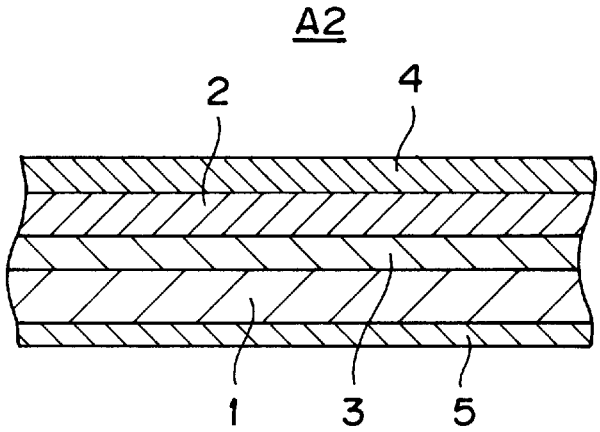
FIG. 2 is a schematic partial cross sectional view illustrating the thermal transfer sheet of the second embodiment of the present invention for attaining the first object.

Now, the thermal transfer sheet of the second embodiment of the present invention for attaining the first object will be described in detail with reference to FIG. 2. FIG. 2 is a schematic partial cross sectional view illustrating the thermal transfer sheet of the aforementioned second embodiment of the present invention.

As shown in FIG. 2, the thermal transfer sheet A2 of the second embodiment of the present invention comprises a substrate sheet 1, a release layer 3 formed on one surface of the substrate sheet 1, a coloring layer 2 formed on the release layer 3, an adhesive layer 4 formed on the coloring layer 2 and a back surface layer 5 formed on the other surface of the substrate sheet 1.

The substrate 1, the coloring layer 2, the release layer 3 and the adhesive layer 4 are identical with those of the thermal transfer sheet A of the first embodiment of the above-described present invention. The same reference numerals are given to these identical constitutional elements, and the description thereof is omitted.

The description of the back surface layer 5 will be given below.

[Back surface layer 5]

The back surface layer 5 is formed on the other surface of the substrate sheet 1 in order to prevent a thermal head from being stuck onto the other surface of the substrate sheet 1 and facilitate the smooth running of the thermal head thereon.

For forming the back surface layer 5, it is preferable to use a composition obtained by adding a lubricant, a surfactant, inorganic particles, organic particles and/or a pigment to a binder comprising a resin.

Representative examples of the resin to be used as a binder may include cellulosic resins such as ethyl cellulose, hydroxy-ethyl cellulose, hydroxy-propyl cellulose, methyl cellulose, cellulose acetate, cellulose butyl acetoacetate and nitrocellulose; vinyl resins such as polyvinyl alcohol, polyvinyl acetate, polyvinyl butylal, polyvinyl acetal, polyvinyl pyrrolidon, acrylic resin, polyacrylamide and acrylonitrile-styrene copolymer; polyester resins; polyurethane resins; and silicone-modified or fluorine-modified urethane resins.

There may preferably be used a bridged resin obtained by mixing any resin having several reactive groups, for example, hydroxyl groups, of the above-mentioned resin, with a crosslinking agent comprising polyisocyanate.

The back surface layer 5 can be formed on the other surface of the substrate sheet 1 by dissolving or dispersing materials in an appropriate solvent, which have been obtained by adding the above-mentioned lubricant, surfactant, inorganic particles, organic particles and/or pigment to the binder comprising the above-mentioned resin, to prepare a composition, applying the thus prepared composition to the other surface of the substrate 1 with the use of any one of the conventional means such as a gravure coater, a roll coater and a wire bar, and drying same.

Figure 3:
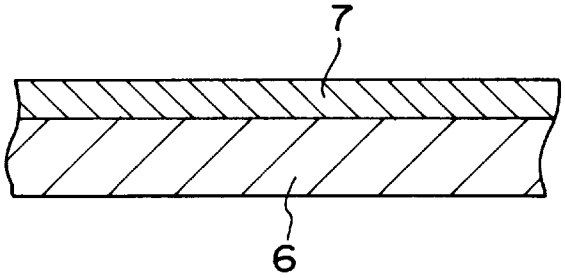
FIG. 3 is a schematic partial cross sectional view illustrating the thermal transfer sheet of the embodiment of the present invention for attaining the second object.

Now, the thermal transfer sheet of the embodiment of the present invention for attaining the second object will be described in detail with reference to FIG. 3. FIG. 3 is a schematic partial cross sectional view illustrating the thermal transfer sheet of the aforementioned embodiment of the present invention.

As shown in FIG. 3, the thermal transfer sheet B of the embodiment of the present invention comprises a substrate sheet 6 and a heat fusible coloring ink layer 7 formed on the one surface of the substrate sheet 6.

In the thermal transfer sheet B of the present invention, a release layer (not shown) may be formed between the substrate sheet 6 and the heat fusible coloring ink layer 7, and an adhesive layer (not shown) may be formed on the heat fusible coloring ink layer 7, as an occasion demands. In addition, a back surface layer (not shown) may be formed on the other surface of the substrate sheet 6 in order to prevent a thermal head from being stuck onto the other surface of the substrate sheet 6 and facilitate the smooth running of the thermal head thereon.

The substrate sheet 6 is identical with the substrate 1 of the thermal transfer sheet A1 of the first embodiment of the present invention for attaining the first object. The description of the substrate sheet 6 is therefore omitted.

The heat fusible coloring ink layer 7 will be described below.

[Heat fusible coloring ink layer 7]

In the heat fusible coloring ink layer 7 of the thermal transfer sheet B of the present invention, there is applicable either an ink layer of any one color of yellow, magenta, cyan and black or an ink layer having a plurality of colors in which at least two kinds of ink of yellow, magenta, cyan and black are applied onto the substrate sheet 6 in the width direction or the longitudinal direction thereof. In either case, the respective ink layer comprises a coloring agent and a binder. Various kind of additives, for example a dispersion agent and an anti-static agent may be added as an occasion demands.

As the respective coloring agents of yellow, magenta and cyan used in the present invention, there are used organic pigments having the chemical composition described below.

An organic pigment of benzimidazolone-mono-azo is used as the coloring agent of yellow, a mixture of organic pigments of quinacridone-mono-azo and benzimidazolone-mono-azo is used as the coloring agent of magenta, and an organic pigment of phthalocyanine is used as the coloring agent of cyan.

It is possible to obtain the heat fusible coloring ink layer 7 having an excellent weatherproofing property, which is harmonized with hues of three primary colors of printing ink used in an offset printing, by using the combination of the above-mentioned specific organic pigments as the respective coloring agents of yellow, magenta and cyan. The heat fusible coloring ink layer 7 of yellow, magenta and cyan can provide an image having an excellent color reproduction property of intermediate color of red, green, violet, gray and the like.

If it is hard to obtain a vivid color of black by a multiple printing with the use of the heat fusible coloring ink layer 7 of yellow, magenta and cyan, there may be provided a black coloring ink layer containing a black coloring agent such as carbon black.

The binder used in the heat fusible coloring ink layer 7 preferably mainly comprises a resin. The representative examples of the resin may include thermoplastic elastomer such as cellulose resin, melamine resin, polyester resin, polyamide resin, polyolefin resin, acrylic resin, styrene resin, ethylene-vinyl acetate copolymer, styrene-butadiene rubber and the like. It is preferable to use the resin having a relatively low softening point of 50 to 80° C. which has conventionally been used as a thermo-sensitive adhesive agent Of the resins used as the binder, the cellulose resin, melamine resin and acrylic resin are preferably used in view of the transferring property, the wear resistance, the heat resistance and the like.

A wax may be added to the resin to an extent that the heat resistance is not degraded, as an occasion demands. As a typical example of the wax, there will be listed up micro-crystalline wax, carnauba wax or paraffin wax. Furthermore, the following waxes may be used: Fischer-Tropsch wax, various kinds of low molecular weight polyethylenes, Japan wax, bees wax, whale wax, insect wax, wool wax, shellac wax, candelilla wax, petrolatum, polyester wax, partially modified wax, fatty acid ester, fatty acid amide, and so on. Of these wax, it is preferable to use the wax having a melting point of 50 to 85° C. With a melting point of up to 50° C., there may be a problem of a storing property. With a melting point of at least 85° C., on the other hand, printing sensitivity may tend to be insufficient.

It is preferable to use an ink composition comprising the coloring agent of 90 to 20 wt. % and the resin of 80 to 10 wt. % in order to form the above-mentioned heat fusible coloring ink layer 7. When the coloring agent content is smaller than 20 wt. %, an amount of the applied composition must be increased, thus leading to insufficient printing sensitivity. When the coloring agent content is larger than 90 wt. %, on the other hand, a sufficient film forming property may not be obtained, thus causing the deterioration of the wear resistance of a printed material.

The heat fusible coloring ink layer 7 can be formed with the use of the heat fusible coloring ink layer forming composition prepared by blending the aforementioned coloring agent and the binder, and in addition, a solvent such as water and organic solvent, if necessary, by means of the conventional known method such as a hot melt coating, a hot lacquer coating, a gravure direct coating, a gravure reverse coating, a knife coating, an air coating and a roll coating, so that the heat fusible coloring ink layer 7 has a thickness of from 0.1 to 5 μm, preferably of from 0.3 to 1.5 μm in a dry condition.

When the thickness of the dried coating film is under 0.1 μm, there may occur a problem of the film forming property, making it impossible to form a uniform ink layer. When the thickness thereof is over 5 μm, on the other hand, high energy is required for the thermal transfer printing, with the result that the printing may be conducted only by the specific thermal transfer printer.

[Release layer]

In the present invention, a release layer (not shown) may be formed between the substrate sheet 6 and the heat fusible coloring ink layer 7, as an occasion demands.

The release layer mainly comprises a wax, and there may be added thereto the thermoplastic elastomer, for example, polyolefin resin, polyester resin or the like, as set forth in the description of the heat fusible coloring ink layer 7.

The release layer can be formed with the use of a release layer forming composition, by means of the conventional known method such as a hot melt coating, a hot lacquer coating, a gravure direct coating, a gravure reverse coating, a knife coating, an air coating and a roil coating, so that the coloring layer 2 has a thickness of from 0.05 to 5 μm in a dry condition. When the thickness of the dried film is under 0.05 μm, it is impossible to inhibit the adhesive property of the coloring layer 2 to the substrate sheet 1

[Adhesive layer]

According to the thermal transfer sheet B of the present invention, it is possible to improve the adhesivity between an image receiving sheet and the heat fusible coloring ink layer 7 by forming the adhesive layer (not shown) on the heat fusible coloring ink layer 7. The adhesive layer mainly comprises thermoplastic elastomer which is soften to provide adhesivity by heat of a thermal head, a laser or the like. A blocking preventing agent such as of wax; amide, ester and salt of higher fatty acid; powder of fluoroplastics or inorganic material or the like may be added to the aforementioned elastomer in order to prevent a blocking phenomenon when winding the obtained thermal transfer sheet into a roll.

As a typical example of the thermoplastic elastomer, there will be listed up ethylene-vinyl acetate copolymer (EVA), ethylene-acrylic acid ester copolymer (EEA), polyester resin, polyethylene, polystyrene, polypropylene, polybutene, petroleum resin, vinyl chloride resin, vinyl chloride-vinyl acetate copolymer, polyvinil alcohol, vinylidene chloride resin, methacrylate resin, polyamide, polycarbonate, polyvinylformal, polyvinyl butyral, acetylcellulose, nitrocellulose, polyvinyl acetate, polyisobutylene, ethylcellolose, polyacetal and the like. It is preferable to use the elastomer having a relatively low softening point, for example, of 50 to 150° C., which is conventionally used as the thermo-sensitive adhesive agent.

The adhesive layer can be formed with the use of an adhesive layer forming composition which is obtained by dissolving or dispersing the above-mentioned thermoplastic elastomer and additives into a hot-melt coating composition or a proper organic solvent or water, by means of the conventional known method such as a hot melt coating, a hot lacquer coating, a gravure direct coating, a gravure reverse coating, a knife coating, an air coating and a roll coating, so that the adhesive layer 4 has a thickness of from 0.05 to 5 μm in a dry condition. With a thickness of the dried film of under 0.05 μm, there may be caused an inferior adhesivity between the image receiving sheet and the coloring layer 2, thus leading to occurrence of printing defect when conducting the thermal transfer printing. With a thickness thereof of over 5 μm, the printing sensitivity may be decreased when conducting the thermal transfer printing, thus making it impossible to obtain satisfactory printing quality.

[Back surface layer]

A back surface layer (not shown) may be formed on the other surface of the substrate sheet 6 in order to prevent a thermal head from being stuck onto the other surface of the substrate sheet 6 and facilitate the smooth running of the thermal head thereon. The back surface layer is identical with the back surface layer 5 of the thermal transfer sheet A2 of the above-described second embodiment of the present invention. The description of this back surface layer is therefore omitted.

The above-described thermal transfer sheets of the present invention may be used as a thermal transfer recording medium which is used for a thermal printer, a facsimile transmission apparatus or the like. In this case, a lead film is connected to the upstream end of the thermal transfer sheet relative to the traveling direction thereof. On the lead film, there may previously be printed (1) an indication including a description and/or descriptive drawings of matters to be attended to, of handling of the thermal transfer recording medium when charging this medium into a cassette or a printer, and/or (2) an indication having an arrow indicating a traveling direction of the thermal transfer sheet. In addition, the downstream end of the thermal transfer sheet relative to the traveling direction thereof may be connected to a feeding bobbin so as to wind the thermal transfer sheet into a coil around the feeding bobbin, and the forwarding end of the above-mentioned lead film may be connected to a receiving bobbin.

EXAMPLES

Now, the present invention will be described hereinbelow in more detail with reference to Experiment Examples and Comparative Examples. In the description appearing hereinafter, part(s) and percentage (%) are part(s) by weight and weight percentage, respectively, unless otherwise noted specifically.

Example A

[Experiment Example A1]

A 4.5 μm thick polyethylene terephthalate film (Product name: "Lumirror" manufactured by TORAY Co. Ltd.) was used as a substrate sheet. On the one surface of the substrate, a back surface layer forming composition having the chemical composition described below was applied in a coating amount of 0.3 g/m$^2$ (based on solid content), and the resultant coating was dried to form a back surface layer.

<Back surface layer forming composition>

Styrene-acrylonitrile copolymer: 11 parts

Linear saturated polyester resin: 0.3 parts

Zincstearylphosphate: 6 parts

Melamine resin powder: 3 parts

Methyl ethyl ketone: 80 parts

Then, on the other surface of the substrate, a release layer forming composition having the chemical composition described below was applied in a coating amount of 0.7 g/m$^2$ (based on solid content) by a gravure coating method, and the resultant coating was dried to form a release layer.

<Release layer forming composition>

Carnauba wax ("WE-95" manufactured by KONISHI KABUSHIKI KAISHA): 10 parts

Water/isopropyl alcohol (wt. ratio of 1/1): 30 parts

Then, on four areas of the thus formed release layer which lay in a row in the width direction of the substrate, coloring layer forming compositions for yellow, magenta, cyan and black having the respective chemical compositions described below were applied, respectively, in a coating amount of 0.6 to 0.8 g/m$^2$ (based on solid content) by the gravure coating method, and the resultant coatings were dried at 70° C. to form a coloring layer comprising rows of yellow, magenta, cyan and black on the same plane.

<Coloring layer forming composition (yellow)>

Mono-azo organic pigment: 28.2 parts

Chlorinated polypropylene: 71.6 parts

Stabilizer: 0.2 parts

Toluene/methyl ethyl ketone (wt. ratio of 1/1): 300 parts

<Coloring layer forming composition (magenta)>

Quinacridone organic pigment: 35.4 parts

Chlorinated polypropylene: 64.4 parts

Stabilizer: 0.2 parts

Toluene/methyl ethyl ketone (wt. ratio of 1/1): 300 parts

<Coloring layer forming composition (cyan)>

Copper-phthalocyanine organic pigment: 27.1 parts

Chlorinated polypropylene: 71.0 parts

Stabilizer: 1.9 parts

Toluene/methyl ethyl ketone (wt. ratio of 1/1): 300 parts

<Coloring layer forming composition (black)>

Carbon black: 31.3 parts

Chlorinated polypropylene: 56.3 parts

Polyethylene wax: 2.7 parts

Dibuthyl phthalate: 6.8 parts

Soybean oil-modified epoxy resin: 1.5 parts

Stabilizer: 1.4 parts

Toluene/methyl ethyl ketone (wt. ratio of 1/1): 300 parts

Then, on the thus formed coloring layer, an adhesive layer forming composition having the chemical composition described below was applied in a coating amount of 0.8 g/m$^2$ (based on solid content) by the gravure coating method, and the resultant coating was dried at 80° C. to form an adhesive layer, thereby obtaining a thermal transfer sheet of the Experiment Example A1 which was identical with the thermal transfer sheet of the second embodiment of the present invention for attaining the first object.

<Adhesive layer forming composition>

Polyester resin: 36.8 parts

Carnauba wax No. 1: 17.6 parts

Oxidized micro-crystalline wax: 2.5 parts

Polyethylene wax: 39.8 parts

Surfactant: 3.7 parts

[Experiment Example A2]

A thermal transfer sheet of the Experiment Example A2 was prepared in the same manner as in the Experiment Example A1 except that the release layer forming composition and the adhesive layer forming composition had the following chemical compositions:

<Release layer forming composition>

Carnauba wax ("WE-95" manufactured by KONISHI KABUSHIKI KAISHA): 9 parts

Acrylonitrile-butadiene copolymer ("JSR0910" manufactured by NIHON GOSEI GOMU KABUSIKI KAHSIA): 1 parts Water/isopropyl alcohol (wt. ratio of 1/3): 20 parts <Adhesive layer forming composition>

Polyester resin: 26.5 parts

Carnauba wax No. 1: 30.9 parts

Oxidized micro-crystalline wax: 4.4 parts

Polyethylene wax: 28.3 parts

[Experiment Example A3]

A thermal transfer sheet of the Experiment Example A3 was prepared in the same manner as in the Experiment Example A1 except that the release layer forming composition and the adhesive layer forming composition had the following chemical compositions:

<Release layer forming composition>

Polyethylene wax: 10 parts

Polyester resin: 20 parts

Carnauba wax: 20 parts

Water/isopropyl alcohol (wt. ratio of 1/3): 100 parts

<Adhesive layer forming composition>

Polyethylene wax: 10 parts

Polyester resin: 20 parts

Oxidized micro-crystalline wax: 5 parts

[Experiment Example A4]

A thermal transfer sheet of the Experiment Example A4 was prepared in the same manner as in the Experiment Example A1 except that the release layer forming composition and the adhesive layer forming composition had the following chemical compositions:

<Release layer forming composition>

Acrylic resin: 77 parts

Vinyl chloride-vinyl acetate copolymer: 19 parts

Polyethylene wax: 3.5 parts

Polyester resin: 0.5 parts

<Adhesive layer forming composition>

Polyester resin: 10 parts

Oxidized micro-crystalline wax: 5 parts

Styrene-butadiene latex: 3 parts

Oxidized micro-crystalline wax: 5 parts

Water/isopropyl alcohol (wt. ratio of 1/2): 30 parts

[Comparative Example A1]

A thermal transfer sheet of the Comparative Example A1 was prepared under the same conditions as in the thermal transfer sheet of the Experiment Example A1 except that no adhesive layer was formed.

A thermal printing was carried out with the use of each of the thermal transfer sheets of the Experiment Examples and the Comparative Example under the following printing conditions:

<Printing conditions>

A single color thermal printing of each of yellow, magenta, cyan and black and a multiple thermal printing of these colors were carried out with the use of a printer "SUMMACHROME" manufactured by SUMMAGRAPHICS CO. LTD., to prepare samples for evaluation. A vinyl chloride sheet manufactured by the U.S.3M Co. Ltd. was used as a image receiving sheet.

Then, for each of the resultant printed materials, i.e., the samples for evaluation, a multiple printing property and the thermal printing property were evaluated by the following method:

<Evaluation method of the multiple printing property and the thermal printing property>

For each of the samples to which the thermal printing had been carried out under the above-described conditions, visual inspection was made to a printed image of the sample, which had been obtained by the above-mentioned single color thermal printing of each of yellow (Y), magenta (M), cyan (C) and black (B) and the above-mentioned multiple printing. Evaluation criteria were as follows:

○: A good printed image was obtained, and a resultant color made by the multiple printing was vivid.

Δ: A printed image was formed and it had a relatively poor adhesivity, which was however within a permissible range ×: A printed image was not formed, or void occurred in portions of a printed image.

Evaluation results are shown in Table 1 below.

TABLE 1

| | Single color printing | | | | Multiple printing | | |
|---|---|---|---|---|---|---|---|
| | Y | M | C | Bk | Y + M | Y + C | M + C |
| Experiment Example A1 | ○ | ○ | ○ | ○ | ○ | ○ | ○ |
| Experiment Example A2 | ○ | ○ | ○ | ○ | ○ | ○ | ○ |
| Experiment Example A3 | ○ | ○ | ○ | ○ | ○ | ○ | ○ |
| Comparative Example A1 | ○ | ○ | ○ | ○ | X | X | X |
| Experiment Example A4 | ○ | ○ | ○ | ○ | Δ | Δ | Δ |

As is clear from Table 1, with respect to the single printing, good results were recognized in the Experiment Examples A1 to A3 and the Comparative Examples A1 and A2. With respect to the multiple printing, good results were recognized in any one of the Experiment Examples A1 to A3, and relatively good results were recognized in Experiment Example A4 and in contrast, unfavorable results were recognized in the Comparative Example A1.

Example B

[Experiment Example B1]

A 4.5 μm thick polyethylene terephthalate film (Product name: "Lumirror" manufactured by TORAY Co. Ltd.) was used as a substrate sheet. On the one surface of the substrate, a back surface layer forming composition having the chemical composition described below was applied in a coating amount of 0.3 g/m$^2$ (based on solid content), and the resultant coating was dried to form a back surface layer.

<Back surface layer forming composition>

Polyester resin: 6.6 parts

Styrene-acrylonitrile copolymer: 41.5 parts

Melamine-aldehyde condensate: 10.4 parts

Urea resin: 20.8 parts

Zincstearylphosphate: 20.8 parts

Then, on the other surface of the substrate, a release layer forming composition having the chemical composition described below was applied in a coating amount of 0.3 to 0.5 g/m$^2$ (based on solid content) by a gravure coating method, and the resultant coating was dried to form a release layer.

<Release layer forming composition>

Acrylic resin: 77 parts

Vinyl chloride-vinyl acetate copolymer: 19 parts

Polyethylene wax: 3.5 parts

Polyester resin: 0.5 parts

Then, on three areas of the thus formed release layer which lay in a row in the width direction of the substrate, coloring layer forming compositions for yellow, magenta and cyan having the respective chemical compositions described below were applied, respectively, in a coating amount of 0.7 g/m$^2$ (based on solid content) by the gravure coating method, and the resultant coatings were dried at 70° C. to form a coloring layer comprising rows of yellow, magenta and cyan on the same plane, thereby obtaining a thermal transfer sheet of the Experiment Example B1 which was identical with the thermal transfer sheet of the embodiment of the present invention for attaining the second object.

<Coloring layer forming composition (yellow)>

Benzimidazolone-mono-azo (Yellow 120): 10 parts

Benzimidazolone-mono-azo (Yellow 180): 10 parts

Acrylic resin: 10 parts

Polyester resin: 12 parts

Clay: 0.5 parts

Dispersing agent: 1.5 parts

Toluene: 32.5 parts

Methyl ethyl ketone: 23.5 parts

<Coloring layer forming composition (magenta)>

2,9-dichloroquinacridone (Red 202): 7.5 parts

Benzimidazolone-mono-azo (Red 176): 7.5 parts

Acrylic resin: 10 parts

Polyester resin: 12 parts

Dispersing agent: 1.5 parts

Toluene: 35.5 parts

Methyl ethyl ketone: 26.5 parts

<Coloring layer forming composition (cyan)>

Phthalocyanine blue (15:4): 9 parts

Acrylic resin: 10 parts

Polyester resin: 12 parts

Silica: 3 parts

Dispersing agent: 1.5 parts

Toluene: 37.5 parts

Methyl ethyl ketone: 27.5 parts

[Experiment Example B2]

A thermal transfer sheet of the Experiment Example B2 was prepared in the same manner as in the Experiment Example B1 except that the back surface layer forming composition, the release layer forming composition and the heat fusible coloring layer forming compositions had the following chemical compositions, and an adhesive layer was formed on the heat fusible coloring ink layer by applying the adhesive layer forming composition having the chemical composition described below in a coating amount of 0.7 g/m$^2$ (based on solid content) by the gravure coating method, and the resultant coating was dried at 80° C.:

<Back surface layer forming composition>

Styrene-acrylonitrile copolymer: 11 parts

Linear saturated polyester resin: 0.3 parts

Zincstearylphosphate: 6 parts

Melamine resin powder: 3 parts

Methyl ethyl ketone: 80 parts

<Release layer forming composition>

Carnauba wax ("WE-95" manufactured by KONISHI KABUSHIKI KAISHA): 10 parts

Water/isopropyl alcohol (wt. ratio of 1/3): 30 parts

<Coloring layer forming composition (yellow)>

Benzimidazolone-mono-azo (Yellow 120): 8 parts

Benzimidazolone-mono-azo (Yellow 180): 8 parts

Cellulose-acetate-butylate resin (CAB): 8 parts

Dispersing agent: 1.2 parts

Toluene/methyl ethyl ketone (wt. ratio of 1/1): 75 parts

<Coloring layer forming composition (magenta)>

2,9-dichloroquinacridone (Red 202): 6 parts

Benzimidazolone-mono-azo (Red 176): 6 parts

Cellulose-acetate-butylate resin (CAB): 8 parts

Dispersing agent: 1.2 parts

Toluene/methyl ethyl ketone (wt. ratio of 1/1): 79 parts

<Coloring layer forming composition (cyan)>

Phthalocyanine blue (15:4): 8 parts

Cellulose-acetate-butylate resin (CAB): 12 parts

Dispersing agent: 0.7 parts

Toluene/methyl ethyl ketone (wt. ratio of 1/1): 80 parts

<Adhesive layer forming composition>

Polyester resin: 36.8 parts

Carnauba wax No. 1: 17.6 parts

Oxidized micro-crystalline wax: 2.5 parts

Polyethylene wax: 39.3 parts

Surfactant: 3.7 parts

[Experiment Example B3]

A thermal transfer sheet of the Experiment Example B3 was prepared in the same manner as in the Experiment Example B2 except that the back surface layer forming composition, the heat fusible coloring layer forming compositions and the adhesive layer forming composition had the following chemical compositions:

<Back surface layer forming composition>

Styrene-acrylonitrile copolymer: 11 parts

Linear saturated polyester resin: 0.5 parts

Zincstearylphosphate: 5 parts

Urea resin powder: 5 parts

Melamine resin powder: 3 parts

Toluene/methyl ethyl ketone (wt. ratio of 1/1): 80 parts

<Coloring layer forming composition (yellow)>

Benzimidazolone-mono-azo (Yellow 120): 8 parts

Benzimidazolone-mono-azo (Yellow 180): 8 parts

Methyl methacrylate (MMA): 4 parts

Butyl methacrylate (BMA): 4 parts

Dispersing agent: 1.2 parts

Toluene/methyl ethyl ketone (wt. ratio of 1/1): 75 parts

<Coloring layer forming composition (magenta)>

2,9-dichloroquinacridone (Red 202): 6 parts

Benzimidazolone-mono-azo (Red 176): 6 parts

Methyl methacrylate (MA): 4 parts

Butyl methacrylate (BMA): 4 parts

Dispersing agent: 1.2 parts

Toluene/methyl ethyl ketone (wt. ratio of 1/1): 79 parts

<Coloring layer forming composition (cyan)>

Phthalocyanine blue (15:4): 8 parts

Methyl methacrylate (MMA): 6 parts

Butyl methacrylate (BMA): 6 parts

Dispersing agent: 0.7 parts

Toluene/methyl ethyl ketone (wt. ratio of 1/1): 80 parts

<Adhesive layer forming composition>

Modified acrylic resin: 12.9 parts

Polyester resin: 12.6 parts

Ethylene glycol monobutyl ether: 3.9 parts

Water: 70.6 parts

[Experiment Example B4]

A thermal transfer sheet of the Experiment Example B4 was prepared in the same manner as in the Experiment Example B1 except that the heat fusible coloring ink layer forming composition had the following chemical compositions:

<Coloring layer forming composition (cyan)>

Phthalscyanine blue (PB 15:4): 8.0 parts

Polyester resin ("Biron #200", mfd by Toyobo K.K.): 8.0 parts

Stabilizer: 0.1 parts

Toluene/methyl ethyl ketone (wt. ratio of 1/1): 80.0 parts

[Comparative Example B1]

A thermal transfer sheet of the Comparative Example B1 was prepared in the same manner as in the Experiment Example B1 except that the heat fusible coloring ink layer forming compositions had the following chemical compositions:

<Coloring layer forming composition (yellow)>

Diallyl yellow PY 14: 8 parts

Chlorinated polyolefin: 20.3 parts

Stabilizer: 0.1 parts

Toluene: 71.6 parts

<Coloring layer forming composition (magenta)>

Brilliant Carmine 6B (PR57:1): 10.0 parts

Chlorinated polyolefin: 18.2 parts

Stabilizer: 0.1 parts

Toluene: 71.7 parts

<Coloring layer forming composition (cyan)>

Phthalocyanine blue (PB15:4): 8.0 parts

Chlorinated polyolefin: 21.0 parts

Stabilizer: 0.6 parts

Toluene: 70.4 parts

A thermal printing was carried out with the use of each of the thermal transfer sheets of the Experiment Examples and the Comparative Example under the following printing conditions:

<Printing conditions>

A single color thermal printing of each of yellow, magenta and cyan and a multiple thermal printing of these colors were carried out with the use of a printer "SUMMACHROME" manufactured by SUMMAGRAPHICS CO. LTD., to prepare samples for evaluation. A vinyl chloride sheet manufactured by the U.S.3M Co. Ltd. was used as an image receiving sheet.

Then, for each of the resultant printed materials, i.e., the samples for evaluation, a weatherproofing property was evaluated by the following method:

<Evaluation method of the weatherproofing property>

Light was irradiated from a xenon electronic lamp onto the surface of the sample with the use of a xenon fade meter manufactured by ATLAS Co. Ltd., and a decreased value of density according to its dose was measured by a reflection density measuring apparatus "MACBETH RD-914". Difference between the density values of the surface of the sample before and after the irradiation of the light was obtained, and the thus obtained value of difference was expressed in percentage for the evaluation of the weatherproofing property. The smaller value expressed in percentage meant an excellent weatherproofing property.

Evaluation results are shown in Table 2 below.

TABLE 2

| | Yellow | Magenta | Cyan |
|---|---|---|---|
| Experiment Example B1 | 1% | 2% | 2% |
| Experiment Example B2 | 1% | 2% | 2% |
| Experiment Example B3 | 3% | 1% | 2% |
| Comparative Example B1 | 35% | 7% | 4% |
| Experiment Example B4 | 1% | 2% | 4% |

As is clear from TABLE 2, the sample of any one of the Experiment Examples B1 to B3 had an excellent weatherproofing property in yellow, magenta and cyan, and especially in yellow and magenta. The sample of the Experiment Example B4 had a relatively poor waterproofing property in cyan, which was however within a permissible range. On the contrary, a poor weatherproofing property was recognized in the samples of the Comparative Examples B1 and B2.

In addition, the samples obtained by the thermal transfer sheet of the present invention had an excellent full color tone reproduction property in an intermediate color of red by a multiple printing of yellow and magenta, an intermediate color of green by a multiple printing of yellow and cyan, an intermediate color of violet by a multiple printing of magenta and cyan, and an intermediate color of gray by a multiple printing of yellow, magenta and cyan.

According to the present invention as described in detail for attaining the first object, the use of the same kind of material in the release layer and the adhesive layer permits to improve a multiple printing property to provide a good printing quality without occurrence of void in a multiple printing portion, and makes it possible to manufacture a thermal transfer sheet excellent in full color tone reproduction property.

According to the present invention for attaining the second object, since the heat fusible coloring ink layer is formed on the one surface of the substrate sheet, and for this ink layer, there are used as pigments having an excellent weatherproofing property, an organic pigment of benzimidazolone-mono-azo for yellow, a mixture of organic pigments of quinacridone-mono-azo and benzimidazolone-mono-azo for magenta, and an organic pigment of phthalocyanine for cyan, or these pigments are used to be combined with resin having an excellent weatherproofing property, a printed material obtained by the thermal transfer sheet can withstand the use of an outdoor bill board for a long time of period, unlike a printed material obtained by the conventional thermal transfer sheet, which easily tends to fade, thus permitting the expanded use of the thermal transfer sheet, for example as a license plate for a vehicle such as a car, a road sign, or the like.

What is claimed is:

1. A thermal transfer sheet comprising a substrate sheet, a release layer formed on an upper surface of said substrate, a coloring layer formed on an upper surface of said release layer and an adhesive layer formed on an upper surface of said coloring layer;

said release layer and said adhesive layer contain the same material; and said coloring layer consists of (a) from 20%–90% wt. % coloring agent and (b) a resin without wax.

2. A thermal transfer sheet as claimed in claim 1, wherein:

said same kind of material is carnauba wax.

3. A thermal transfer sheet as claimed in claim 1, wherein:

said same kind of material is polyethylene wax.

4. A thermal transfer sheet as claimed in claim 1, wherein:

said coloring layer comprises a heat fusible coloring ink layer; and an organic pigment of benzimidazolone-mono-azo is used as a coloring agent of yellow in said heat fusible coloring ink layer, a mixture of organic pigments of quinacridone-mono-azo and benzimidazolone-mono-azo is used as a coloring agent of magenta in said heat fusible coloring ink layer, and an organic pigment of phthalocyanine is used as a coloring agent of cyan in said heat fusible coloring ink layer.

5. A thermal transfer sheet as claimed in claim 4, wherein:

material mainly comprising resin is used as a binder in said heat fusible coloring ink layer.

* * * * *